United States Patent [19]

Skinner et al.

[11] 4,076,457

[45] Feb. 28, 1978

[54] DOWNHOLE PUMP SPEED CONTROL

[75] Inventors: David R. Skinner, Odessa; Miles L. Sowell; Marvin W. Justus, both of Levelland, all of Tex.

[73] Assignee: Standard Oil Company (Indiana), Chicago, Ill.

[21] Appl. No.: 724,037

[22] Filed: Sep. 17, 1976

[51] Int. Cl.[2] ..... F04B 49/00

[52] U.S. Cl. ..... 417/45; 417/46; 417/53

[58] Field of Search ..... 417/18, 20–22, 417/44, 46, 43, 53

[56] References Cited

U.S. PATENT DOCUMENTS

| | | | |
|---|---|---|---|
| 2,180,400 | 11/1939 | Coberly | 417/46 |
| 2,224,295 | 12/1940 | Hofer | 417/20 |
| 2,269,189 | 1/1942 | Downs | 417/22 |
| 2,593,729 | 4/1952 | Coberly | 417/390 |
| 2,637,276 | 5/1953 | Coberly | 417/21 |
| 3,434,370 | 1/1969 | Law | 415/1 |
| 3,535,053 | 10/1970 | Jednacz | 417/18 |
| 3,570,243 | 3/1971 | Comer et al. | 60/431 |

FOREIGN PATENT DOCUMENTS

| | | | |
|---|---|---|---|
| 915,544 | 1/1963 | United Kingdom | 417/43 |

*Primary Examiner*—William L. Freeh

*Attorney, Agent, or Firm*—Albert C. Metrailer; Arthur McIlroy

[57] ABSTRACT

This is a method and apparatus for controlling a downhole, hydraulically actuated pump. Two fluid flow monitoring means generate signals which are a function of the power fluid flow rate to the downhole pump and the return fluid flow rate from the well. An automatic controller causes the power fluid flow rate to be maintained essentially directly proportional to the return flow. Thus, the power fluid flow is not varied in the opposite direction of any change in return flow to maintain the return fluid flow constant, but conversely, is changed in a manner which will tend to accentuate any changes in the return fluid flow.

10 Claims, 4 Drawing Figures

DOWNHOLE PUMP SPEED CONTROL

CROSS REFERENCE TO RELATED APPLICATION

In concurrently filed application Ser. No. 724,060 entitled "Hydraulic Control System Underflow Valve Control," filed Sept. 17, 1976, now U.S. Pat. No. 4,042,025, by Skinner, Sowell and Justus, there is disclosed a system which controls the flow rates through the hydraulic pumping unit's cyclone separator to provide for self-cleaning of the cyclone underflow and good separation of solids in the cyclone and, at the same time, maintains a predetermined level of the liquid in the horizontal suction vessel. This co-pending invention can be used with the embodiments of the invention described herein in which the triplex pump is fairly constant (i.e., driven by a conventional AC motor) but is generally not applicable to the embodiments in which the speed of the triplex pump is varied over a wide range.

BACKGROUND OF THE INVENTION

This invention relates to hydraulic pumping systems for pumping well fluids, and more particularly to the control of the power fluid flow to the downhole, hydraulically actuated pump.

Hydraulically actuated downhole pumps have been used rather than beam pumping units in many locations. Hydraulic units are especially attractive in deeper and higher producing wells.

A hydraulic pumping system uses an aboveground pump (typically one aboveground triplex pump for each well but a large pump can be used for several wells) to supply pressurized fluid, some of which is used as power fluid to actuate the downhole, hydraulically actuated pump. The downhole pump generally returns at least some of the power fluid, together with produced well fluids. A portion of the total return fluid is then conditioned for use as power fluid. A bypass valve is connected to allow some of the fluid from the aboveground pump to bypass the downhole pump. In the past, this bypass valve has been manually adjusted to vary the speed of the downhole pump to achieve the desired number of strokes per minute.

Hydraulic pumping systems are described in, for example, U.S. Pat. No. 2,046,769, U.S. Pat. No. 2,119,737, and U.S. Pat. No. 2,593,729 issued to Coberly and U.S. Pat. No. 3,709,292 and U.S. Pat. No. 3,782,463 issued to Palmour.

SUMMARY OF THE INVENTION

It has been discovered that there are variations which naturally occur from hour to hour in the amount of fluid which flows into the wellbore and these result in significant variations in the amount of well fluid available to be pumped. If the pump is operated at a slow constant speed, production is significantly reduced. If the pump is operated at a constant speed which is too fast, the downhole pump will receive insufficient fluid at its inlet and excessive wear will result. Thus, it has been determined that the power fluid flow rate should not be varied to maintain a constant downhole pump speed, but conversely, the power fluid flow rate should be maintained essentially directly proportional to the return flow from the well.

Two fluid flow monitoring means are used to generate signals which are a function of the power fluid flow rate in the downhole pump and the return fluid flow rate from the well. A flow control means is used to control the power fluid flow rate, and thereby the speed of the downhole pump. The automatic controller has inputs connected to the fluid flow monitoring devices and has an output connected to the flow control means. The controller automatically generates an output signal to cause the flow control means to maintain the power fluid flow rate essentially directly proportional to the return fluid flow rate. The flow control means is preferably either a means of controlling the aboveground pump speed or a valve positioner together with a bypass valve.

BRIEF DESCRIPTION OF THE DRAWINGS

A better understanding of the invention may be obtained by reference to the accompanying drawings in which.

DESCRIPTION OF THE PREFERRED EMBODIMENTS

Figure 1:
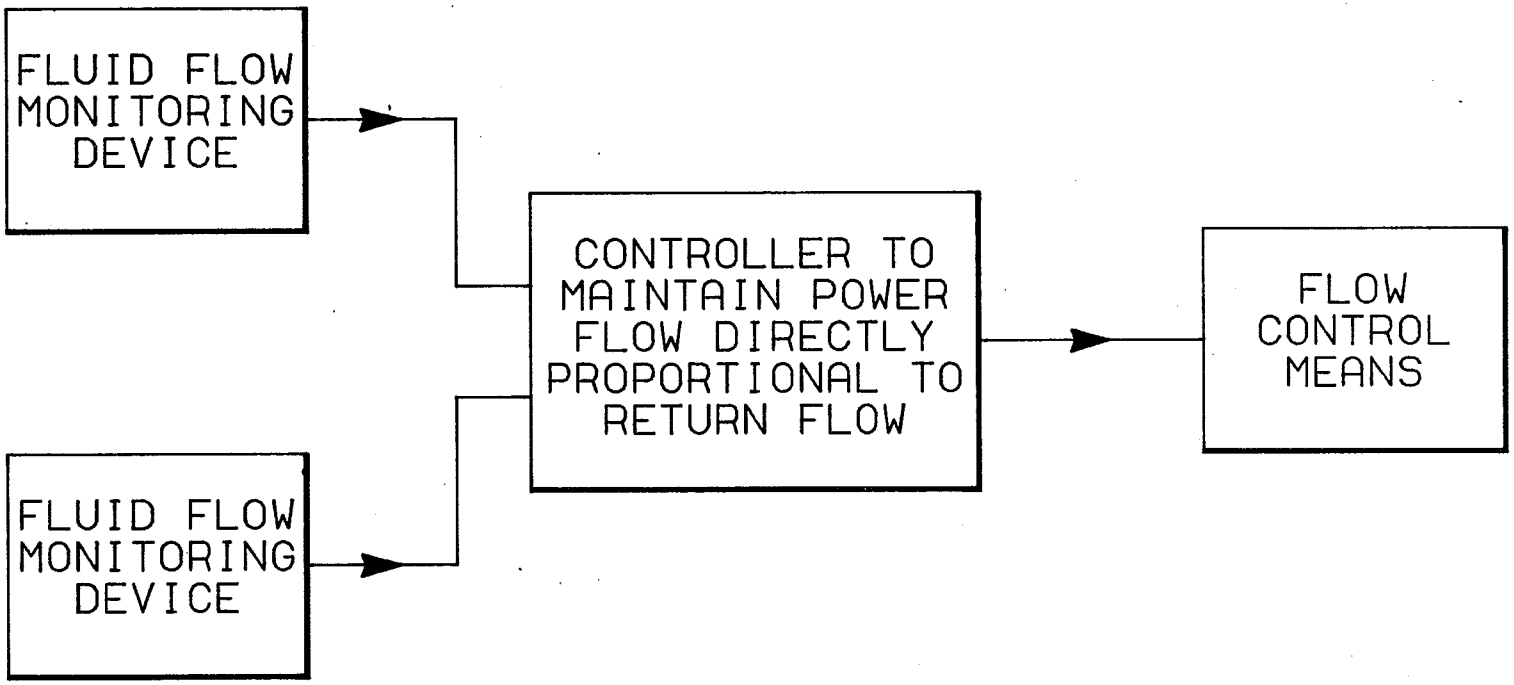
FIG. 1 is a block diagram showing the relationship of the flow control means, the automatic controller, and the two fluid flow monitoring means.

FIG. 1 shows the basic relationship of the elements of the invention. It is important to note that neither the fluid flow nor the return fluid flow (nor the net production flow which is the difference between the return fluid flow and the power fluid flow) is kept constant. Rather, a reduction in return fluid flow will result in control action which reduces the power fluid flow. While this can result in further reduction of the return fluid flow (and also reduction of net production flow), in practice the control system works well and both undersupply of power fluid to the pump and oversupply of power to the pump are avoided.

Figure 2:
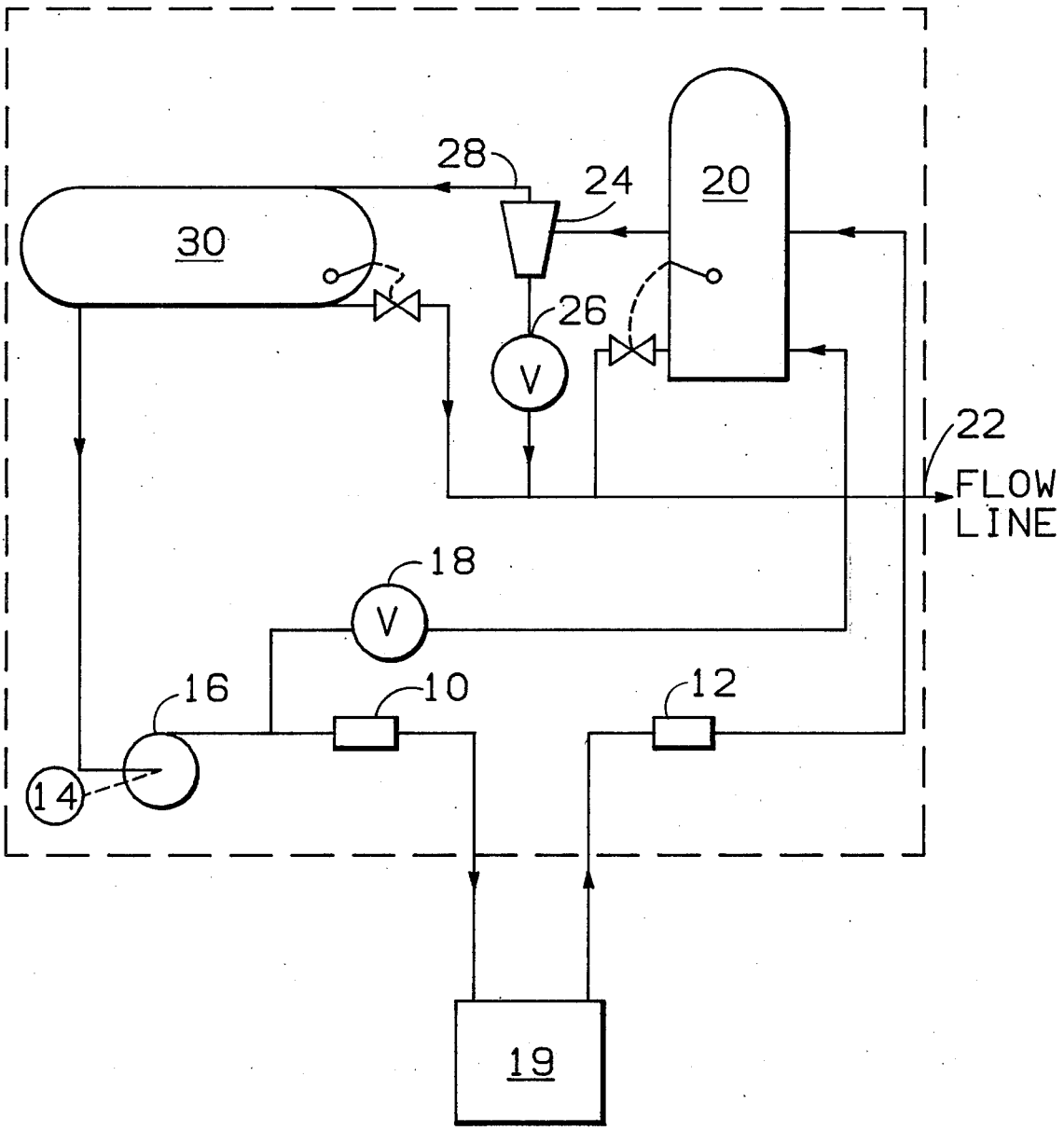
FIG. 2 shows one arrangement of flow monitoring means on a schematic of a hydraulic pumping system.

FIG. 2 shows a schematic of a hydraulic pumping system in which a bypass valve is used to control the flow of power fluid to a downhole pump. In this configuration, the two fluid flow monitoring devices are a power fluid turbine meter 10 and a return fluid turbine meter 12. An electric motor 14 drives the triplex aboveground pump 16 and the portion of its output fluid which is not sent through bypass valve 18 flows through the power fluid turbine meter 10 to actuate the downhole pump 19. The downhole pump 19 returns fluid through the return fluid turbine meter 12 to the vertical separator 20. Fluid which flows through the bypass valve also flows into the vertical separator 20. Some fluid from the vertical separator 20 generally goes to the flowline 22. The remainder of the flow goes to the cyclone separator 24. A portion of the cyclone separator flow (with most of the solids) goes out the underflow valve 26 to the flowline 22. Conditioned fluid comes out the cyclone separator overflow 28 and flows to the horizontal suction vessel 30. This conditioned fluid is then available to be pumped to downhole pump 19 by the aboveground triplex pump 16.

It can be seen that the flow rate in the flowline 22 is equal to the net produced fluid and that this, on the average, will be equal to the return fluid flow rate minus the power fluid flow rate. Although some measurement difficulty may be presented by gas in the line 22, this flow net produced fluids could be monitored by a fluid flow monitoring device and used as a part of the control system to replace either the power fluid turbine meter or the return fluid turbine meter. For example, the production could be measured in the flowline 22 together with the power fluid flow rate by power fluid turbine 10 and the ratio of net produced fluid to power fluid maintained constant. As the net produced fluid flow equals the return fluid flow minus the power fluid flow, maintaining the power fluid flow rate directly proportional to net produced fluid flow rate also maintains the power fluid flow rate directly proportional to the return fluid flow rate.

It can also be seen that if the downhole pump efficiency (in terms of net produced fluid flow rate divided by power fluid flow rate) is determined primarily by the fluid level in the borehole, these controllers maintain the level in the borehole generally constant.

Figure 3:
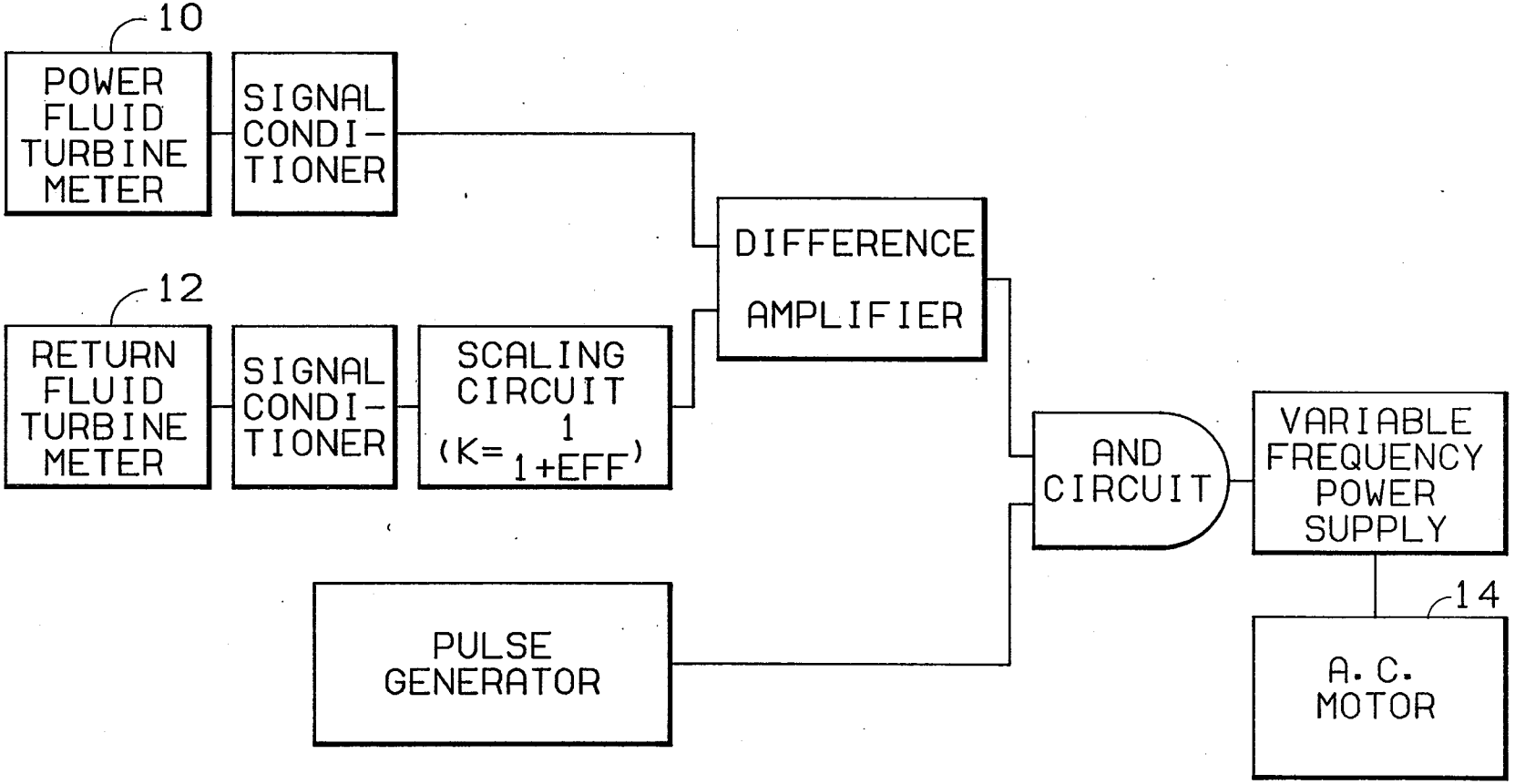
FIG. 3 is a block diagram showing an embodiment for controlling the speed of the aboveground pump.

FIG. 3 shows a block diagram of a control system in which a speed of the AC motor 14 is varied to alter the speed of the triplex pump 16, and thus the speed of the downhole pump 19. The power fluid turbine meter 10 and the return fluid turbine meter 12 can be located as in FIG. 2, but the bypass valve 18 and its associated piping as shown in FIG. 2 would be eliminated. Signals from the turbine meters are appropriately conditioned and a return fluid signal is scaled by an appropriate proportionality constant for the particular downhole pump being used. The difference amplifier is used to compare the power fluid signal and the scaled return fluid signal and produce an error signal output which is the difference between these quantities. While this error signal could possibly be used to adjust the frequency of the variable frequency power supply directly, this direct connection would generally result in overcontrol which would cause oscillations about the desired speed. The AND circuit and the pulse generator are used as a signal blocking circuit and allow only periodic adjustment of the flow control means (here, a variable frequency power supply) and thus prevent overcontrolling.

Variable frequency power supplies (these also generally vary the voltage in proportion to the output frequency) are known in the art. U.S. Pat. No. 3,568,771 issued to Vincent and Drake on Mar. 9, 1971, describes pumping foaming crude and using a variable frequency power supply to vary the speed of a submersible electric pump, as a function of the bulk density of the fluid to be pumped.

There are, of course, other means of controlling the speed of the aboveground pump 16. These include mechanical transmissions and variable slip clutches.

The setting of the scaling circuit of FIG. 3 can either be determined empirically by an operator analyzing pump performance, or can be set to a predetermined value based on the particular type of downhole pump 19 which is used. Table I below shows the value of the scaling constant for several of the typical efficiencies of a single-action downhole pump. These efficiencies are shown in terms of net produced fluid as a percentage of power fluid flow rate.

TABLE I

| Efficiency | Constant |
|---|---|
| 35% | 0.74 |
| 37% | 0.73 |
| 40% | 0.71 |
| 42% | 0.70 |

TABLE I-continued

| Efficiency | Constant |
|---|---|
| 45% | 0.69 |
| 48% | 0.67 |

Typical double-action downhole pumps have efficiencies generally in the 75–95% range. Several values for the scaling circuit constant for various efficiencies in this range are shown in Table II below.

TABLE II

| Efficiency | Constant |
|---|---|
| 75% | 0.57 |
| 80% | 0.56 |
| 85% | 0.54 |
| 90% | 0.53 |
| 95% | 0.51 |

As noted above, different types of pumps can have different characteristics and the scaling constant should be adjusted appropriately for the type of pump 19 used.

Variations in the flow diagram could, of course, be made. Circuitry could, for example, be arranged to subtract the power fluid value from the return fluid value and then subtract this net from an appropriate scaling constant times the power fluid value. This circuitry would employ a scaling constant which is directly related to the efficiency (0.9 if efficiency were 90%).

Figure 4:
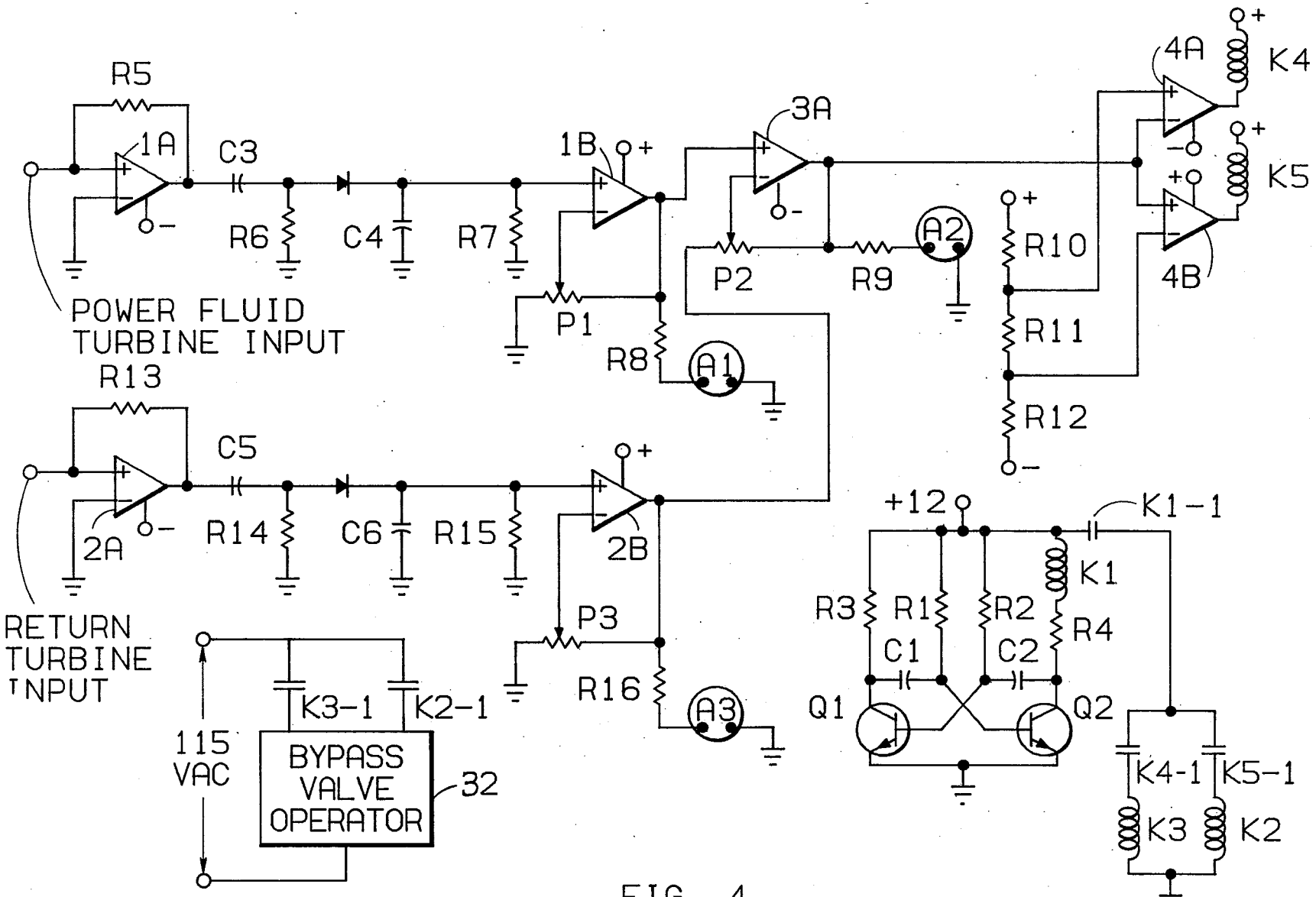
FIG. 4 is a circuit diagram of a particular embodiment that has been used to control the speed of the downhole pump by throttling of a bypass valve.

FIG. 4 shows a schematic of portions of a downhole pump speed control system. Such a system could, of course, be in many different forms including electromechanical, electronic or pneumatic, for example. Table III below gives typical component values for the components in FIG. 4.

TABLE III

| | Value |
|---|---|
| R1 | 2K |
| R2 | 470K |
| R3 | 1.2K |
| R4 | 270 ohms |
| R5 | 10K |
| R6 | 10K |
| R7 | 50K |
| R8 | 820K |
| R9 | 270K |
| R10 | 270K |
| R11 | 36K |
| R12 | 270K |
| R13 | 10K |
| R14 | 10K |
| R15 | 50K |
| R16 | 820K |
| C1 | 250 mfd |
| C2 | 50 mfd |
| C3 | .01 mfd |
| C4 | 30 mfd |
| C5 | .01 mfd |
| C6 | 30 mfd |
| P1 | 10K |
| P2 | 25K |
| P3 | 10K |
| A1,A2,A3 | 0-200 microamps |
| 1A-1B, 2A-2B | Raytheon 4558 |
| 3A and 4A-4B | Raytheon 4558 |
| Q1,Q2 | 2N4141 |

Generally, operational amplifiers 1A and 1B and their associated circuitry provide signal conditioning for the signal from the power fluid turbine meter 10. Potentiometer P1 can be used to calibrate microammeter A1 to indicate the power fluid flow rate in some convenient units (i.e., barrels per day). Similarly, operational amplifiers 2A and 2B condition the return fluid turbine meter signal and P3 potentiometer is used to calibrate microammeter A3 in the same units in which A1 is calibrated. Operational amplifier 3A provides the difference amplifier and potentiometer P2 provides an adjustable scaling circuit. Microammeter A2 provides an indication of the error signal coming out of the difference amplifier. In this configuration, operational amplifiers 4A and 4B are provided to give a band of operation and avoid unnecessary operation of the bypass valve operator 32 as could be caused by minor deviations. The pulse generator is provided by Q1, Q2 and their associated circuitry. The AND circuit is provided by relay contact K1-1 which must be closed in addition to the contacts of either relay K4 or K5 before the bypass valve operator 32 is energized.

If, for example, the flow rate of fluid flowing into the wellbore decreased, the head in the well would drop and the return fluid flow rate would decrease slightly and the error signal out of operational amplifier 3A would cause a signal to actuate operational amplifier 4A (once the error signal became large enough to exceed the dead band). K4 would energize and contact K4-1 would close. When the pulse energizes relay K1 (here, a 100-ms pulse occurs about every 120 seconds), K3 energizes and closes contact K3-1. The bypass valve operator 32 is driven in the open direction for approximately the pulse duration. Opening the bypass valve will allow a greater quantity of fluid from the triplex pump to bypass the downhole pump and the speed of the downhole pump will be slowed.

Conversely, if the flow rate into the borehole increases, the return fluid signal will rise. When the dead band is exceeded, operational amplifier 4B will energize relay K5 and, when relay K1 is energized, relay K3 will be energized and the bypass operator 32 will close the bypass valve slightly to increase the speed of the downhole pump. In either case, the bypass valve will be driven to reestablish the predetermined proportionality between the power fluid flow and the return fluid flow (the proportionality constant being determined directly by setting of the wiper of potentiometer P2).

While a valve which controls the power fluid flow directly by throttling the flow could possibly be used with some types of above-ground pumps, an AC motor-driven triplex pump is normally used for such operations and is a piston-type pump which puts out an essentially constant flow (the AC motor speed varying only slightly with load). Regulating the flow through the pump by directly throttling its output flow is impractical on such pumps.

In any case, the speed of the downhole pump is to be varied to accommodate whatever flow is entering the wellbore. While this flow entering the wellbore has not been found to change significantly in a few minutes' time (and thus is necessary to correct the pump speed or valve position only at 2-minute intervals, for example), hour-to-hour variations have been found to be quite significant. This system provides downhole pump speeds related to what the well can effectively produce but avoids pump damage which results from attempting to pump at a rate greater than that entering the wellbore.

It should be noted that there are many alternate fluid flow monitoring means. The pressure drop through any flow restriction is, of course, indicative of flow rate. The power fluid flow rate can also be determined from downhole pump speed by an analysis of the pressure fluctuations on either of the lines connected to the well. As the flow through the triplex pump driven by an AC motor is relatively constant, the power fluid flow could also be calculated on a single well per hydraulic pumping system arrangement by measuring the bypass flow or even by calculating the bypass flow based on the degree to which the bypass valve is open.

The invention is not to be construed as limited to the particular forms described herein, since these are to be regarded as illustrative rather than restrictive. The invention is intended to cover all configurations which do not depart from the spirit and scope of the invention.

I claim:

1. In a well fluid hydraulic pumping system of the type wherein power fluid is used to hydraulically actuate a downhole pump and a portion of the return fluid is conditioned for use as power fluid, the improvement which comprises:

a. two fluid flow monitoring means for generating signals which are a function of power fluid flow rate and return fluid flow rate;

b. flow control means adapted to control the power fluid flow rate and thereby the speed of the downhole pump; and c. an automatic controller having inputs connected to said fluid flow monitoring means and having an output connected to said flow control means, said controller generating an output signal to cause the flow control means to maintain the power fluid flow rate essentially directly proportional to the return fluid flow rate.

2. The system of claim 1 wherein a signal blocking circuit is connected between said controller output and said flow control means to allow only periodic adjustment of said flow control means.

3. The system of claim 2 wherein said monitoring means comprise a power fluid turbine meter and a return fluid turbine meter.

4. The system of claim 3 wherein said controller comprises a scaling circuit with an input and an output, said scaling circuit input being connected to the return fluid flow turbine meter and a difference circuit having first and second input and an output, said difference circuit first input being connected to the power fluid flow turbine meter and said difference circuit second input being connected to the output of the scaling circuit and said difference circuit output being connected to said flow control means.

5. The system of claim 4 wherein said downhole pump is a double-acting pump and the said scaling circuit has an output to input signal ratio of between 0.51 and 0.57.

6. The system of claim 4 wherein said downhole pump is a single-acting pump and said scaling circuit has an output to input signal ratio of between 0.67 and 0.73.

7. The system of claim 1 in which the flow control means is a bypass valve and associated piping connected to controllably allow a portion of the pressurized fluid from the aboveground pump to flow through the bypass valve and bypass the downhole pump.

8. The system of claim 1 in which the flow control means is an aboveground pump speed controlling means.

9. A method of controlling a downhole hydraulically actuated pump, said pump being actuated by power fluid and returning fluid to the surface and a portion of the return fluid being conditioned for use as power fluid, said method comprising:

a. generating two fluid flow rate signals, said signals being functions of the power fluid flow rate and the return fluid flow rate;

b. generating an error signal indicative of any deviation from the power fluid flow rate signal being directly proportional to the return fluid rate; and c. using said error signal to activate flow control means whereby the flow of power fluid is controlled to reduce the error signal.

10. The method of claim 9 wherein said error signal is equal to the difference between the power fluid flow rate signal and a proportionality constant times the return fluid flow rate signal and said proportionality constant is selected based on said downhole hydraulically actuated pump.

* * * * *